US005885132A

United States Patent [19]

Meyer

[11] Patent Number: 5,885,132

[45] Date of Patent: Mar. 23, 1999

[54] METHOD AND APPARATUS FOR MACHINING AN ANNULAR LAYER OF BORON NITRIDE OR DIAMONDS OF GRINDING DISCS

[75] Inventor: Hans-Robert Meyer, Hollern-Twielenfleth, Germany

[73] Assignee: Ernest Winter & Sohn Diamantwerkzeuge GmbH & Co., Norderstedt, Germany

[21] Appl. No.: 806,309

[22] Filed: Feb. 26, 1997

[30] Foreign Application Priority Data

May 24, 1996 [DE] Germany ..... 196 20 972.2

[51] Int. Cl.[6] ..... B24B 49/00; B24B 51/00

[52] U.S. Cl. ..... 451/6; 451/8; 451/5

[58] Field of Search ..... 451/21, 5, 6, 8, 451/9, 10, 28, 11, 54, 55, 56, 58, 63, 443, 57

[56] References Cited

U.S. PATENT DOCUMENTS

| | | | |
|---|---|---|---|
| 4,151,684 | 5/1979 | Wada et al. | 451/21 |
| 4,266,374 | 5/1981 | Asano et al. | 451/21 |
| 4,359,841 | 11/1982 | Barth et al. | 451/56 |
| 4,539,779 | 9/1985 | Donner | 451/56 |
| 4,897,967 | 2/1990 | Maruyama et al. | 451/21 |
| 5,291,691 | 3/1994 | Unno et al. | 451/56 |
| 5,547,414 | 8/1996 | Ohimori | 451/56 |
| 5,620,358 | 4/1997 | Furukawa et al. | 451/56 |

FOREIGN PATENT DOCUMENTS 36 39 584 A1 of 0000 Germany .

OTHER PUBLICATIONS

König, W., Averkamp, Th., Durst, H.–U.: "Überwachungssystem für den Abrichtprozess " In: Industrie–Anzeiger Nr. 18 v. 3.3.1982, 104. Jhg., S. 30 –33.

*Primary Examiner*—Timothy V. Eley
*Assistant Examiner*—Derris H. Banks
*Attorney, Agent, or Firm*—Vidas, Arrett & Steinkraus

[57] ABSTRACT

A method for machining an annular layer or coating of grinding discs of boron nitride or diamonds at the circumference and/or the end face of a disc by means of a tool grinding disc which is especially coated with a silicon carbide layer. The workpiece disc is fed with a first predetermined rate of feed towards the workpiece disc. After the contact of the tool disc with the workpiece disc the tool disc is fed with a reduced rate of feed until a cylindrical or plane surface of the grinding coating of the workpiece disc is achieved. One or a plurality of ultrasonic sensors measure the sound or the vibration generated by the spindle of the workpiece disc. The sound or vibration analyzed in order to automatically reduce the rate of speed if at least one ultrasonic sensor detects contact between the tool disc and the workpiece disc. The grinding process is stopped if at least one of the sensors detects that the workpiece disc is cylindrical or plane, respectively, at least during one revolution term.

13 Claims, 2 Drawing Sheets

METHOD AND APPARATUS FOR MACHINING AN ANNULAR LAYER OF BORON NITRIDE OR DIAMONDS OF GRINDING DISCS

The invention refers to a method for machining an annular layer of boron nitride or diamonds of grinding discs at the circumference and/or the end surface thereof.

The surface and cylindrical grinding by means of grinding discs having a boron nitride or diamond layer is usually carried out with grinding discs having a silicon carbide layer. It is intended to provide the workpiece disc with a sufficient precise plane surface at the end face or a sufficient roundness at the circumference. By the means of this machining it is desired that the true running is within the required tolerance range. The layer of the workpiece disc is to be removed only as far as it is necessary for generating a finish surface of satisfactory quality. A machining beyond this point extends the machining time and results in an undesired removal of the tool disc and the workpiece disc.

Up to now the described process was carried out manually. The operator feeds the tool disc with an arbitrary feed rate against the rotating workpiece disc and has to take care that the contact between the disc is not by an impact because otherwise an additional deviation from the plane or round surface is the result. It requires additional labor to eliminate these deviations. During the machining operation the operator selects the feed at his "feeling" and terminates the machining if he on the basis of his experience he has the impression that the cylindrical or plane surface is reached. This is subsequently tested by a respective test operation. This conventional method includes failures. Additionally, it is relatively expensive.

It is an object of the invention to provide a method for the machining of layers of grinding discs consisting of boron nitride and diamonds which can be carried out completely automatically and effects reduced labor.

In the invention the vibration or sound is measured generated by a spindle rotating the workpiece disc. If the spindle and the workpiece disc are completely cylindrical and bearing is free of unbalance the driving of the disc must not generate any vibrations. Nevertheless, such vibrations occur in practice and can be eliminated by a corresponding filtering. Vibrations which can be measured and exploited for control are generated during machining by two factors: the contact of the tool disc with the workpiece disc and the ovalization or unevenness, respectively of the coating of the workpiece disc. The changes of these forces caused by ovalization and occurring upon contact of the tool disc with the workpiece disc result in corresponding vibrations of the spindle. If the tool disc is fed towards the coating of the workpiece disc with a predetermined rate this process can be immediately stopped as soon as the sensor determines a contact of the tool disc with the workpiece disc. The signal of the sensors is analyzed, and the contact-free state or the contact state between the discs can be discriminated relatively simple by the amplitude of the signal changing significantly. As soon as a contact is detected, a corresponding signal is transmitted to the feed drive. In the feed drive the rate is significantly reduced to a predetermined rate which corresponds to the rate during machining. It is also conceivable to change the feed rates step-by-step at predetermined time units.

The machining is carried out along a predetermined program which is adapted to geometrical or material conditions. As mentioned, specific vibrations are generated at the spindle of the workpiece disc as long as evenness or roundness are not achieved. These vibrations can be used to indicate these phenomena. The vibrations tend to develop against zero as soon as evenness or a cylindrical surface is achieved. The machining is finished and the tool disc is moved back to its initial position.

In an embodiment of the invention two ultrasonic sensors can be used. They are used such that their signals can be used in common or optional. In the latter case both sensors have to indicate the desired state in order to terminate the starting and machining process, respectively. It is also conceivable to use one ultrasonic sensor to control the starting process and another for the machining process.

Naturally, the output signals of the sensors are a mixture of various frequencies. For a better analyzation according to the invention it is preferred to define an average value by a smoothing circuit. If for example the average value increases relatively suddenly it is an indication that the tool disc has contacted the workpiece disc. If the surface to be machined is even or cylindrical, respectively, the average value is constant. If a constant value is measured over a predetermined time duration, the machining process can be stopped.

An embodiment example of the invention is subsequently described along accompanying drawings.

Figure 1:
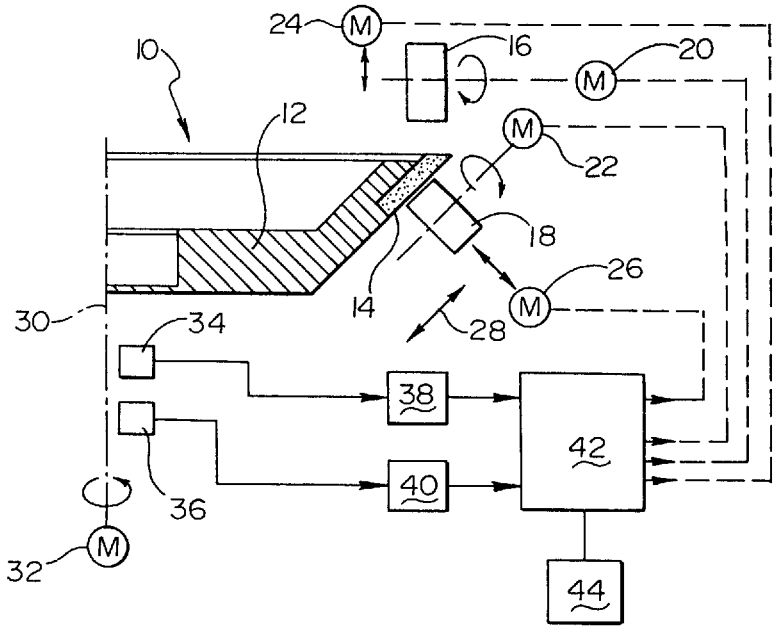
FIG. 1 shows diagrammatically the machining of a diamond disc with a tool disc and a corresponding control device for a workpiece disc.

A grinding disc 10 in FIG. 1 (workpiece disc) has a layer or coating of diamonds and includes a cup-shaped body 12 and a conical grinding coating or layer 14. After the press-forming of the grinding disc 10 it is necessary to machine the coating 14 in order to achieve the desired evenness at the end face and the desired cylindrical surface at the circumference. The same goes with the trueing of the grinding disc 10 after a predetermined time of operation.

The grinding of coating 14 takes place with a grinding disc having a layer or coating of silicon carbide either in position 16 or position 18, with the tool disc being rotatingly driven by a motor 20 or 22, respectively. The associated grinding machine is not illustrated. It includes also driving means for the feed of disc 16 or 18 (tool disc) which are designated in FIG. 1 with 24 or 26, respectively. A further driving means necessary for the transverse feed according to arrow 28 which is not shown for the sake of simplicity.

By means of the spindle the workpiece disc 10 is chucked or clamped in a grinding machine. The spindle is indicated at 30. It is rotatably driven by a motor 32. The spindle 30 is associated with two ultrasonic sensors 34, 36. The output signals of sensors 34, 36 are transmitted into analyzing blocks 38, 40. The output thereof is connected with a control device 42 for the individual motors or driving means. This is indicated by dashed lines. The control device 42 is associated with a programming block 44. The arrangement shown is functioning as described in the following.

Figure 2A:
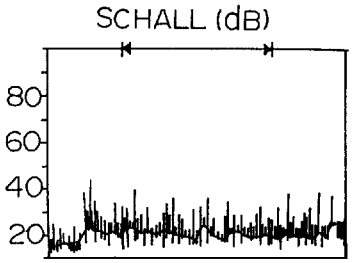
FIG. 2 shows the output signal of a first sensor during circumferential grinding of the workpiece disc of FIG. 1 in the non-smoothed (a) and the smoothed state (b).
Figure 2B:
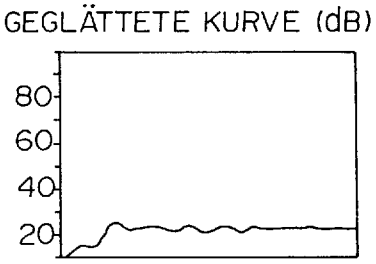
Figure 3A:
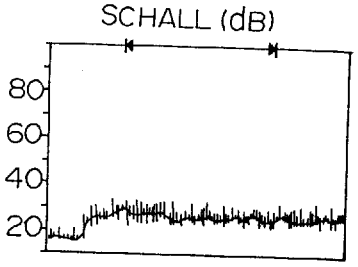
FIG. 3 shows the output signal of a first sensor for the surface grinding of the workpiece disc of FIG. 1 in the non-smoothed and smoothed state.
Figure 3B:
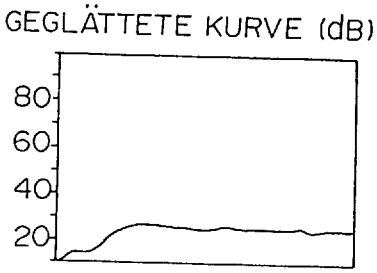
Figure 4A:
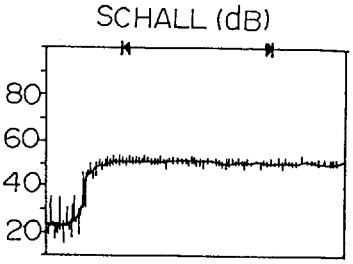
FIG. 4 shows the output signal of a second sensor in the smoothed and non-smoothed state.
Figure 4B:
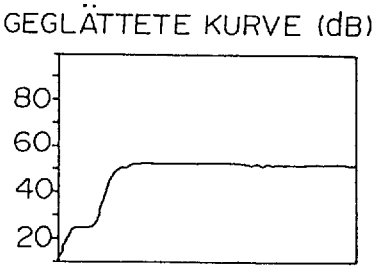

First, the workpiece disc 10 is mounted to the grinding machine. The tool disc 16 or 18 is spaced correspondingly from the grinding coating 14. This space is illustrated smaller than normally existing. After the start of the grinding machine which may be initiated by an operator or may be carried out automatically, the tool disc 16 or 18 is moved towards the coating 14 (along the arrow) by means of motor 24 or 26, respectively. Due to the geometrical relations the travel path is known so that the largest portion of the travel path can be covered with a relatively high rate of feed. The last portion of the travel path can be covered by creep operation. Independent of whether creep operation is provided or not, the first contact between disc 16 or 18 with coating 14 results in a significantly amplified vibration amplitude of spindle 30 which can be clearly seen in FIG. 2*a*. In FIGS. 2 to 4 the signal graph of the sensors 34, 36 is indicated by decibel in relation to the time level. Referring to disc 16 or 18 the graph of FIG. 2*b* or 3*b* is achieved after a corresponding smoothening of the graph of FIG. 2*a* or 3*a*. The first larger increment of FIG. 2*b* or 3*b* indicates that a contact between disc 16 or 18 with coating 14 has taken place. Now, the machining operation starts which is predetermined by programming stage 44. Since first evenness and cylindrical surface of coating 14 is not prevailing, spindle 30 is subject to corresponding vibrations. This can be clearly seen at the left end of the graph in FIG. 4*a*. As soon as a cylindrical surface is achieved, a higher sound level is the result, however, having only minimal alterations. A smoothening of graph of FIG. 4*a* leads to a constant value upon the desired machining according to FIG. 4*b*. This is an indication that a plane surface or a cylindrical surface has been achieved. The control device controls the driving means correspondingly in order to stop further machining and to move the disc 16 or 18 into the initial position for the machining of the next position or the next workpiece disc, respectively.

It is noted that the sensors according to FIG. 1 can be piezo-crystals which measure the sound pressure emanating from the spindle.

I claim:

1. A method for machining a circular workpiece grinding disc having an annular grinding layer having a circumferential surface and an end surface by means of a tool grinding disc, particularly having a silicon carbide layer, the grinding disc mounted for rotation on a spindle, comprising the steps of:

feeding the tool disc towards a grinding layer surface of said workpiece disc with a first rate of feed until engagement with said workpiece disc;

detecting engagement with the grinding layer surface by the tool disc by analyzing sound vibrations made by the rotating spindle a plurality of ultrasonic sensors;

moving the tool disc against the grinding layer surface with a predetermined reduced second rate of feed until the grinding layer surface is sufficiently machined by analyzing the sound vibrations made by the rotating spindle with at least one of the ultrasonic sensors.

2. The method of claim 1, wherein an average signal or graph is formed from the output signals of said sensors, and the feeding of said tool disc or the driving of the tool disc or of the workpiece disc, respectively, is stopped if the graph of the average value is approximately constant.

3. The method of claim 1, wherein the rate of feed or the feeding of said tool disc during engagement of said tool disc with said workpiece disc is controlled in dependence on the level of the sound signal.

4. The method of claim 2 wherein the rate of feed or the feeding of said tool disc during engagement of said tool disc with said workpiece disc is controlled in dependence on the level of the sound signal.

5. An apparatus for machining of an annular coating of boron nitride or diamonds of a grinding disc at their circumference comprising at least one grinding tool disc, in particular having a coating of silicon carbide, said tool disc being rotatingly driven by a first driving motor, the retaining means for the tool disc being rotatingly driven by a second driving motor towards said workpiece disc or away therefrom, accommodation means for the rotary support of said workpiece disc, a second driving motor for rotatingly driving said workpiece disc through a spindle, at least two ultrasonic sensors associated with said spindle, evaluation means for the output signals of said ultrasonic sensors and control means for said driving motors in order to control said driving motors in accordance with the output signals of said ultrasonic sensors.

6. A method for machining a grinding disc with a tool grinding disc, the grinding disc having an annular grinding layer, the grinding layer having a circumferential surface and an end surface, comprising the steps of:

a) attaching the grinding disc to a spindle;

b) rotating the spindle and grinding disc;

c) rotating the tool disc;

d) moving the tool disc towards a surface of the grinding layer with a first rate of feed;

e) detecting engagement with the grinding layer surface by the tool disc by analyzing sound vibrations made by the rotating spindle with an ultrasonic sensor;

f) moving the tool disc against the grinding layer surface with a predetermined reduced second rate of feed, and g) stopping the grinding process when the grinding layer surface is sufficiently machined by analyzing the sound vibrations made by the rotating spindle with the ultrasonic sensor.

7. The method of claim 6 wherein the grinding layer surface is the circumferential surface.

8. The method of claim 6 wherein the grinding layer surface is the end surface.

9. Apparatus for machining a grinding disc with a rotating tool grinding disc, the grinding disc having an annular grinding layer, the grinding layer having a circumferential surface and an end surface, comprising:

a) a spindle for mounting and rotating the grinding disc;

b) first feeding means for moving the rotating tool disc towards a surface of the grinding layer with a first rate of feed;

c) first detecting means for detecting engagement with the grinding layer surface by the rotating tool disc by analyzing sound vibrations made by the rotating spindle with an ultrasonic sensor;

d) second feeding means for moving the rotating tool disc against the grinding layer surface with a predetermined reduced second rate of feed, and e) second detecting means for stopping the grinding process when the grinding layer surface is sufficiently machined by analyzing the sound vibrations made by the rotating spindle with the ultrasonic sensor.

10. The apparatus of claim 9 wherein the grinding layer surface is the circumferential surface.

11. The apparatus of claim 9 wherein the grinding layer surface is the end surface.

12. The apparatus of claim 9 further including a second ultrasonic sensor and wherein the output signals of the two sensors is averaged and engagement is detected when the average value is approximately constant.

13. The apparatus of claim 9 further including a second ultrasonic sensor and wherein the output signals of the two sensors is averaged and the machining is stopped when the average value is approximately constant.

* * * * *